US005824154A

United States Patent [19]

Freti

[11] Patent Number: 5,824,154

[45] Date of Patent: Oct. 20, 1998

[54] COATING BLADE

[75] Inventor: Silvano Freti, Bursinel, Switzerland

[73] Assignee: BTG Eclépens S.A., Eclépens, Switzerland

[21] Appl. No.: 814,039

[22] Filed: Mar. 10, 1997

[30] Foreign Application Priority Data

Dec. 20, 1996 [SE] Sweden ..... 9604737

[51] Int. Cl.[6] ..... B05C 11/02

[52] U.S. Cl. ..... 118/126; 118/123

[58] Field of Search ..... 118/123, 126; 427/356; 162/281

[56] References Cited

U.S. PATENT DOCUMENTS

| | | | |
|---|---|---|---|
| 3,874,900 | 4/1975 | Post et al. . | |
| 4,450,205 | 5/1984 | Itaba et al. . | |
| 4,549,933 | 10/1985 | Judd et al. | 162/281 |
| 4,880,672 | 11/1989 | Eriksson . | |
| 4,895,071 | 1/1990 | Benton . | |
| 5,031,569 | 7/1991 | Ericksson . | |
| 5,048,453 | 9/1991 | Ericksson . | |
| 5,119,755 | 6/1992 | Beisswanger | 118/261 |
| 5,133,281 | 7/1992 | Ericksson . | |

FOREIGN PATENT DOCUMENTS

| | | |
|---|---|---|
| 0 362 174 | 4/1990 | European Pat. Off. . |
| WO 93/09290 | 5/1993 | WIPO . |
| WO 95/00256 | 1/1995 | WIPO . |
| WO 95/17264 | 6/1995 | WIPO . |

*Primary Examiner*—David A. Simmons
*Assistant Examiner*—Calvin Padgett
*Attorney, Agent, or Firm*—Burns, Doane, Swecker & Mathis, L.L.P.

[57] ABSTRACT

A coating blade (5) for controlled application and smoothing of a coating composition on a travelling paper web (7) supported by a co-rotary roll (9), said blade (5) comprising a steel strip (13) elongated in a first direction between first and second edge sections, said first edge section engaging the paper web (7) and being provided with an abrasive wear resistant deposit (15) to extend the life of the blade, wherein an intermediate layer (17) positioned between said deposit (15) and said steel strip (13), said layer (17) having a higher resistance to abrasive wear than said deposit (15).

20 Claims, 2 Drawing Sheets

COATING BLADE

The present invention relates to a coating blade for controlled application and smoothing of a coating composition on a travelling paper web supported by a co-rotary roll. In a conventional manner said blade comprises a steel strip, one edge of which is provided with an abrasive wear resistant coating or deposit to extend the life of the blade.

In conventional coating of a travelling paper web usually margin sections of the paper along both edges thereof will remain uncoated. This will result in a situation where the coating material along the border lines on both sides off the paper web will dry more quickly than the coating material inbetween said borders due to a higher degree of water absorbtion along the border lines of the coating. The practical disadvantage by such faster drying of the coating material is a faster wear of the coating blade around the coating borders, whereas the intermediate section of the blade will be subjected to a substantially slower wear. The fast wear of the blade at these local areas results in frequent blade changes because a minor edge wear can be tolerated in the coating process so as not to impair the paper quality or disturb the process. If such local wear becomes too significant too much coating material will pass beneath the blade at these borders areas and may cause coating build-up on downstream rolls. When said abundance of coating material is drying, it may cause, by scaling, damage to the coated paper or to the downstream rolls by local wear of the rolls. Scaling is constituted by the fact that thick dry coating at the border lines can detach from the paper.

The use of coating blades provided with a ceramic deposit along the edge in engagement with the paper web usually increases the life of the blade compared to uncoated steel blades, but since the intensity of abrasive wear is higher in the edge areas the blade has to be replaced although the major part thereof is still useful.

Attempts have been made to avoid this problem of local wear of the coating blade. Thus, the application of edge lubrication is described in PCT application W095/17264. The solution presented therein performs well—but requires installation and entails operational surveillance and maintanance.

The present invention has for a main purpose to provide a new coating blade for the application of a coating composition on a travelling paper web.

Another object of the invention is to provide a coating blade comprising a steel strip and an abrasive wear resistant coating provided thereon to extend the life of the blade.

Yet another object of the invention is to provide a coating blade residing in a sandwich design, whereby the life of the blade will be substantially extended, a high quality of the coated paper yet being maintained.

Still another object of the invention is to provide a coating blade provided with a wear resistant material to extend the life of the blade with maintained good smoothing of the coating onto the paper to reach a high quality.

Another object of the invention is to provide a coating blade with a sandwich design containing a high wear resistant material as an intermediate layer without requirement for a smoothing operation residing in a high quality coating.

For these and other objects of the invention which will be clear from the following disclosure the invention provides for a coating blade for controlled application and smoothing of a coating composition on a travelling paper web supported by a co-rotary roll. The coating blade according to the invention comprises a steel strip elongated in a first direction between the first and second edge sections, said first edge section engaging the paper web and being provided with an abrasive wear resistant deposit to extend the life of the blade. The coating blade is characterized by an intermediate layer positioned between said deposit and said steel strip, said intermediate layer having a higher resistance to abrasive wear than said coating or deposit.

The intermediate layer is suitably comprised by a material selected from metal carbides, borides, nitrides and composites thereof In a conventional manner said metal carbide can be embedded in a metal matrix.

The intermediate layer preferably has a thickness within the range from about 50 $\mu$m to about 150 $\mu$m.

Said intermediate layer may be constituted by a cermet of a carbide and a metal and the layer preferably has an abrasive wear resistance which is 2 to 6 times higher than that of the wear resistant deposit.

It is particularly preferred that said intermediate layer is constituted by chromium carbide and Cr-Ni.

The wear resistant deposit of the blade according to the present invention is preferably constituted by a ceramic, such as a metal oxide, A preferred oxide is alumina, optionally together with a quantity of another metal oxide, such as zirconium oxide. This quantity may vary from about 3% to about 40% by weight based on the total composition.

The wear resistant deposit has conventionally a thickness of about 0.1 to about 1.0 mm, such as from about 0.2 to about 0.5 mm, and a width in a second direction normal to said first direction and in the plane of the steel strip of from about 4 to about 12 mm. It is preferred that the intermediate layer has a width in said second direction not exceeding that of said wear resistant deposit.

The present invention will now be further described more in detail by non-limiting examples with reference to the appended drawings. In the drawings FIG. 1 is a diagrammatic plan view of a detail section of a coating device;

FIGS. 2*a* and 2*b* show cross-sections A—A and B—B indicated in FIG. 1;

Figure 1:
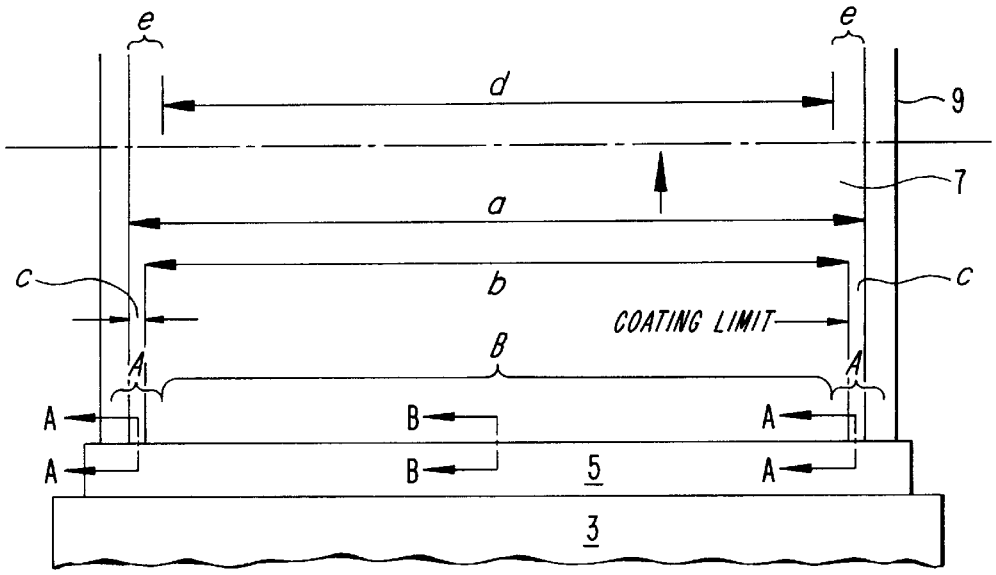

FIG. 1 illustrates conventional blade coating techniques showing part of a coating apparatus of a conventional design. A blade holder 3 carries a coating blade 5 which is in engagement with a travelling paper web 7, the direction of travel being indicated by an arrow. Paper web 7 is supported by a backing roll 9 which co-rotates with the paper web 7.

Upstream of the coating blade 5 coating material is supplied to the web by an applicator not shown, and when entering the blade contact area the coating material will be evenly distributed over the paper web 7, excess thereof being removed in a manner not shown. The coating material is applied to the paper web over a width indicated by double arrow b. Accordingly, the paper is not coated across its full width as indicated by double arrow a, but uncoated areas indicated by c remain along the edges of the paper web 7. After the coating operation the final paper will be trimmed along the edges thereof to remove scrap sections indicated by e.

Figure 2A:
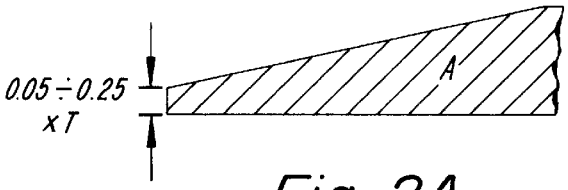
Figure 2B:
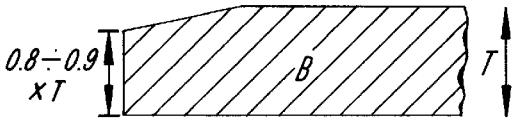

In FIGS. 2A and 2B showing cross-sections A—A and B—B of FIG. 1 the differences in wear rates between the edge sections and the mid section of the blade are illustrated. Due to the fact that the areas of the blade around the border lines of the coating material applied to the web will be subjected to a much faster rate of wear as illustrated in FIG. 1A the blade has to be replaced even though the wear of the main section of the blade corresponding to FIG. 1B is very low, typically from about 5 to about 20% of the total thickness only. This means that the blade has to be replaced by a new blade although only sections A as indicated in FIG. 1 have been subjected to extensive wear, whereas section B would still be useful.

Figure 3:
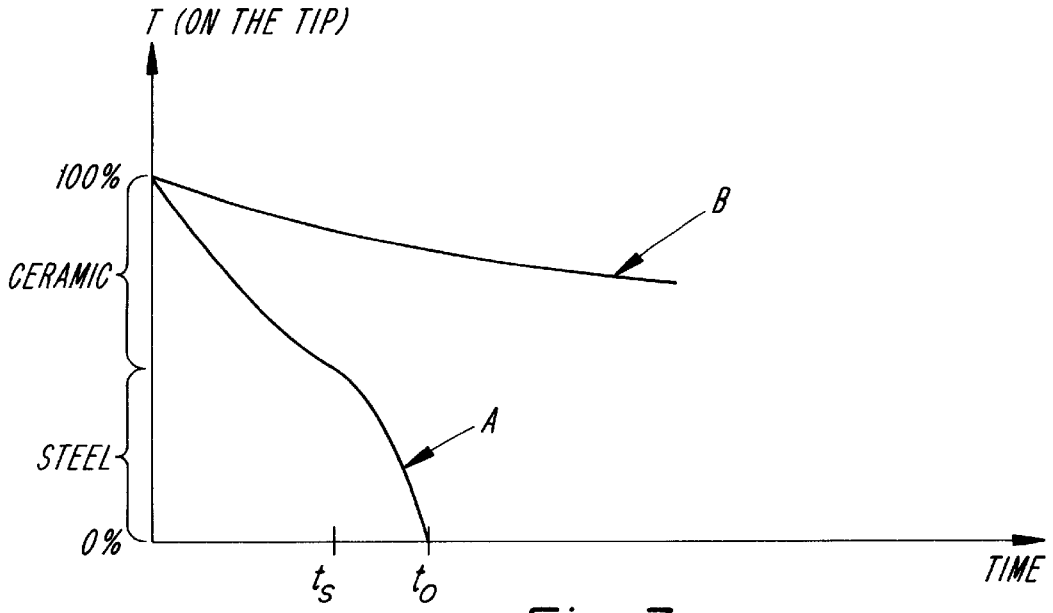
FIG. 3 is a diagram showing the differential wear rates at sections A (border lines or coating limits) and B.

FIG. 3 shows a diagram on extent of wear in percent of blade thickness at the tip thereof plotted against time. The ordinate shows the total thickness of ceramic and steel as 100%, and the abscissa shows the time of wear. Curve A corresponds to the wear of sections A in FIG. 1, whereas curve B reflects the wear of the mid section B of the blade. It can be seen from the diagram curve A that the time For the wear to extend to the steel strip, ts, is relatively short and the wear then rapidly increases after reaching the steel strip.

Figure 4:
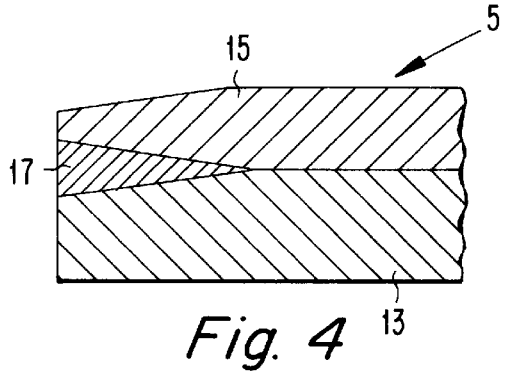
FIG. 4 shows a cross-section of an embodiment according to the invention.
Figure 5:
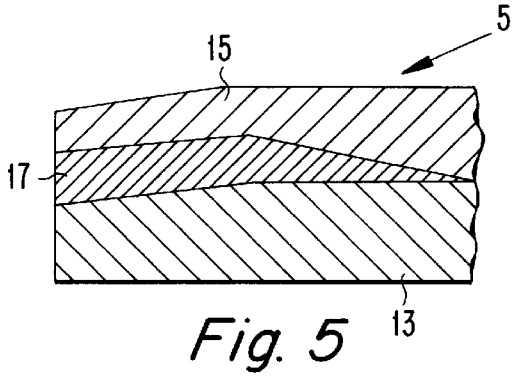
FIG. 5 shows a similar cross-seciton of an alternative embodiment.
Figure 6:
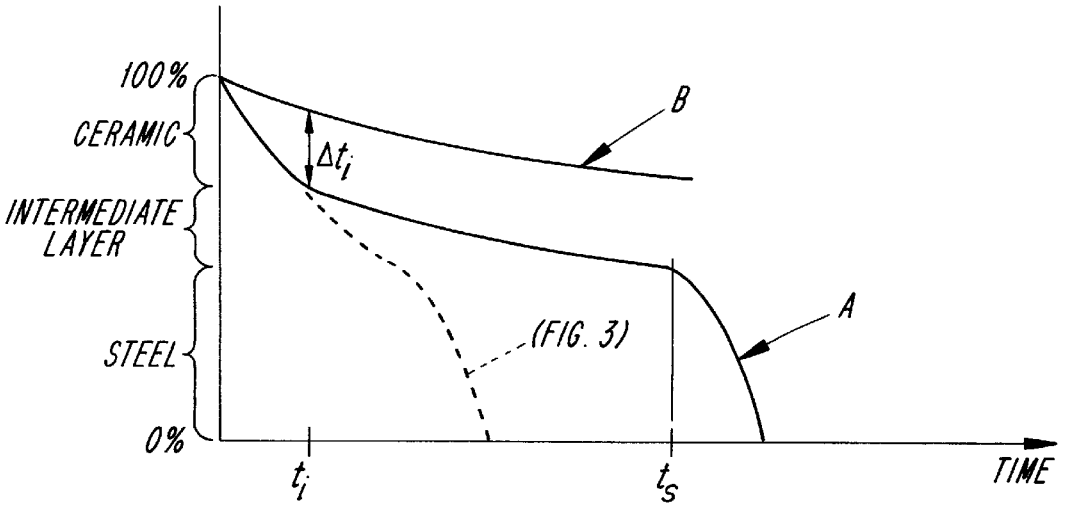
FIG. 6 shows a diagram corresponding to that of FIG. 3 on differential wear rates at sections A and B for a coating blade designed in accordance with the present invention.

FIGS. 4 and 5 illustrate cross-sections through blade embodiments according to the present invention. The blade in FIG. 4 comprises steel strip 13 having a bevel along the edge facing the travelling paper web. Along said bevel an intermediate layer 17 has been applied, such as by plasma spraying, HVOF-spraying (high velocity oxy-fuel), or other suitable deposition techniques, and this intermediate layer is preferably comprised by tungsten carbide-cobalt or chromium carbide-nickel chromium. This intermediate layer preferably has a carbide content within the range about 75% to about 96%.

On top of the intermediate layer 17 a ceramic deposit 15 has been applied, such as by plasma spraying, HVOF-spraying or the like, said deposit 15 extending beyond the intermediate layer 17 along the surface of the steel strip 13. The ceramic deposit 15 conventionally consists of a metal oxide or mixture of metal oxides, such as alumina, optionally together with zirconium oxide.

FIG. 5 shows an alternative embodiment of the coating blade according to the invention. In this embodiment the intermediate layer 17 extends further back into the space between the ceramic deposit 15 and the steel strip 13. In the embodiment according to FIG. 5 the intermediate layer 17 is substantially coextensive with the ceramic deposit 15.

In FIG. 5 a diagram corresponding to that of FIG. 3 is shown. Again, the ordinate shows the total thickness of the blade section according to FIGS. 4 and 5 as 100%. In this case, thanks to the higher wear resistance of the intermediate layer 17, the time ts for the abrasion to reach the steel strip is significantly longer and the blade can accordingly be operated for a correspondingly longer time before replacement.

The present invention enables significant extension of the life of coating blades while maintaining a high quality coating. The sandwich design disclosed herein is not restricted to the embodiments described above but it only requires that the intermediate layer has a higher resistance to abrasive wear than the wear resistant deposit. Accordingly, the invention is limited only by its definition in the appended claims.

I claim:

1. A coating blade for controlled application and smoothing of a coating composition on a traveling paper web supported by a co-rotary roll, the blade comprising:

a steel strip, the steel strip being elongated in a first direction between first and second edge sections;

an abrasive wear resistant deposit; and an intermediate layer positioned between the deposit and the steel strip, the layer having a higher resistance to abrasive wear than the deposit.

2. A coating blade according to claim 1, wherein the intermediate layer comprises a material selected from metal carbides, borides, and nitrides, composites of metal carbides, borides, and nitrides, and metal carbides embedded in a metal matrix.

3. A coating blade according to claim 2, wherein the intermediate layer has a thickness of from about 50 to about 150 $\mu$m.

4. A coating blade according to claim 2, wherein intermediate layer is a cermet of a carbide and a metal.

5. A coating blade according to claim 2 wherein the deposit includes a metal oxide.

6. A coating blade according to claim 2, wherein the deposit has a thickness of about 0.1 to about 1.0 mm in a first direction, and a width in a second direction normal to the first direction and in a plane of the steel strip of from about 4 to about 12 mm.

7. A coating blade according to claim 2, wherein the intermediate layer has a width not exceeding that of said deposit.

8. A coating blade according to claim 1, wherein the intermediate layer has a thickness at a tip of the blade within a range from about 50 $\mu$m to about 150 $\mu$m.

9. A coating blade according to claim 1, wherein intermediate layer is a cermet of a carbide and a metal.

10. A coating blade according to claim 9, wherein the intermediate layer includes a material having an abrasive wear resistance which is 2 to 6 times higher than that of the deposit.

11. A coating blade according to claim 10, wherein the intermediate layer includes chromium carbide and Cr-Ni.

12. A coating blade according to claim 1, wherein the deposit includes a metal oxide.

13. A coating blade according to claim 12, wherein the deposit includes alumina.

14. A coating blade according to claim 13, wherein the deposit includes the alumina together with a quantity of another metal oxide.

15. A coating blade according to claim 14, wherein the other metal oxide is zirconium oxide.

16. A coating blade according to claim 1, wherein the deposit has a thickness of about 0.1 to about 1.0 mm in a first direction, and a width in a second direction normal to the first direction and in a plane of the steel strip of from about 4 to about 12 mm.

17. A coating blade according to claim 16, wherein the intermediate layer has a thickness of from about 50 to about 150 $\mu$m.

18. A coating blade according to claim 17, wherein the steel strip has a thickness of about 0.3 to about 0.6 mm.

19. A coating blade according to claim 16, wherein the steel strip has a thickness of about 0.3 to about 0.6 mm.

20. A coating blade according to claim 1, wherein the intermediate layer has a width in not exceeding that of the deposit.

* * * * *